United States Patent [19]

Hall

[11] 4,155,614

[45] May 22, 1979

[54] CONNECTOR ASSEMBLY FOR ANODE BUTTON OF A CATHODE RAY TUBE

[75] Inventor: Harold E. Hall, Middlefield, Ohio

[73] Assignee: Blasius Industries, Inc., Bedford, Ohio

[21] Appl. No.: 896,712

[22] Filed: Apr. 17, 1978

[51] Int. Cl.[2] ..... H01J 5/46; H01R 11/22

[52] U.S. Cl. ..... 339/60 R; 174/50.52; 313/331; 315/85; 339/143 R; 339/256 T

[58] Field of Search ..... 339/59 R, 60 R, 61, 339/143 R, 143 T, 144 T, 256 T, 263 R, 252 T; 313/331, 356, 51; 174/50.5, 50.52, 50.53; 315/85

[56] References Cited

U.S. PATENT DOCUMENTS

| | | | |
|---|---|---|---|
| 2,784,386 | 3/1957 | MacFadden | 339/143 T X |
| 3,412,366 | 11/1968 | Pittman | 339/60 R |
| 3,486,162 | 12/1969 | Leitmann | 339/256 T X |
| 3,609,654 | 9/1971 | Wallo | 339/263 R X |
| 3,666,343 | 5/1972 | McNeill | 375/85 X |

*Primary Examiner*—Gerald A. Dost
*Assistant Examiner*—E. F. Desmond
*Attorney, Agent, or Firm*—Meyer, Tilberry & Body

[57] ABSTRACT

An improved anode connector assembly for a cathode ray tube comprises a resilient rubber cap having a cavity receiving a U-shaped metal bracket which opens toward the outer end of the cavity. The bracket is interengaged with the cap against displacement relative thereto, and a bare end portion of an insulated anode supply conductor extends through the cap into overlying relationship with the bridge portion of the bracket and is bent to form a loop. A U-shaped metal clip having leg portions for engaging the anode button has its bridging portion disposed in the cap cavity in overlying relationship with respect to the conductor loop. A threaded fastener extends through the bridging portion of the clip, through the loop and into threaded engagement with the bridging portion of the bracket. The fastener secures the conductor wire between the bridging portions and secures the clip to the bracket against displacement from the cap cavity. A metal shield plate is mounted in the cap in surrounding relationship with respect to the legs of the clip to restrict X-ray radiation, and the shield plate includes flanges extending inwardly of the cap cavity along portions of the legs of the clip to optimize shielding.

28 Claims, 7 Drawing Figures

CONNECTOR ASSEMBLY FOR ANODE BUTTON OF A CATHODE RAY TUBE

CROSS-REFERENCE TO RELATED APPLICATION

This application provides improvements with respect to the connector assembly shown in my copending patent application Ser. No. 788,835 filed Apr. 19, 1977, and now abandoned.

BACKGROUND OF THE INVENTION

This invention relates to the art of electrical connectors, and more particularly to an electrical connector for connecting a high voltage power supply to a standard anode button which is embedded in the envelope of a cathode ray tube.

Cathode ray tubes, such as television display tubes, typically have a conductive button embedded in the side of the envelope for conducting the anode voltage to the inside of the tube. The button is in the shape of an outwardly facing cup having an annular flange extending inwardly around its outer rim creating parallel inner and outer annular surfaces which are in turn parallel to the inner and outer surfaces of the cathode ray tube envelope. Unfortunately, such cathode ray tube buttons are not opaque to the transmission of X-rays generated inside the tube.

Electrical connectors heretofore provided for connecting a high voltage power supply to such anode buttons include a resilient dish-like cap of rubber supporting a clip member having legs extending outwardly for engagement under the anode button flange when the cap is flattened against the outer surface of the cathode ray tube envelope. The high voltage conductor extends through the cap and a bare end portion of the conductor wire is generally soldered to the clip. Among the problems encountered in connection with previous connectors of this type is the high amount of X-rays emitted through the button, and which amount of X-ray emission has increased as higher and higher anode voltages have been employed. Further, assembly of such connectors heretofore has first required attachment of the clip to the bare conductor wire and then joining of the conductor wire and cap by pushing the free end of the conductor wire through the conductor passageway in the cap from the interior of the cap so as to pull the clip into its embedded position within the cap. This procedure is not only tedious and time consuming, but also imposes undesirable stresses on the clip at the joint between the clip and conductor. As a result of such stresses, the conductor and clip, as well as the joint therebetween, is subject to the possibility of damage or weakening of the character which can effect structural integrity of the joint and/or the ability for the clip to firmly interengage with the anode button against unintended disengagement therefrom. Any separation of the clip and anode button is undesirable in that it can result in increased X-ray radiation. Moreover, it will be appreciated that a connection between the bare conductor and clip provided by solder or the like, whether or not weakened during assembly with the cap as described above, is subject to being fractured or completely broken by a person jerking on the high voltage wire leading to the cap in an effort to remove the connector from the cathode ray tube. Any such fracture of course can affect electrical continuity, and any complete separation of the conductor and clip of course requires replacement of the connector assembly.

SUMMARY OF THE INVENTION

In accordance with the present invention, an improved anode connector clip assembly is provided which, in accordance with one aspect of the invention, provides improved structural integrity in the joint between the clip and bare end of the high voltage conductor, whereby electrical continuity through the joint is assured as well as increased strength against separation of the bare end of the conductor when the connector is assembled with respect to a cathode ray tube. More particularly, the clip assembly according to the present invention is locked in place in the connector cap by means of a mechanical fastener such as a screw which tightly couples the clip component with a bracket component supported in the cap against separation therefrom. The bare end of the high voltage conductor is bent to form a loop disposed between the clip and bracket and is thus clampingly engaged therebetween by the mechanical fastener. This enables the bare end of the conductor to be formed into a loop and then inserted into the cap through the high voltage conductor passageway from outside the cap and into position overlying the brackets. The clip is then positioned in the cap and joined to the bracket by the fastener. It will be appreciated, therefore, that a strong mechanical joint is achieved to assure electrical continuity between the conductor and clip assembly and retension of the clip assembly in the cap. Moreover, the assembly procedure is achieved without subjecting the component parts to bending and tensional stresses of the character which endanger the structural integrity of the joint between the clip and conductor wire. Furthermore, the mechanical connection in accordance with the present invention provides a strong joint structure against separation of the bare end of the conductor from the clip by jerking on the high voltage conductor, and looping of the bare end of the conductor around the mechanical fastener enhances such structural integrity. It will be appreciated too that the assembly operation is achieved with ease and in a minimum amount of time, enabling the connector assembly to be produced at a lower cost than heretofore possible.

In accordance with another aspect of the invention, the clip assembly includes an X-ray shielding component which, in connection with the clip component and the mechanical connection between the clip and bracket, enables optimizing X-ray shielding. More particularly in this respect, the shielding component is in the form of an apertured disc completely surrounding the legs of the clip, thus optimizing the surface area of the shielding component. Additionally, the preferred structural arrangement of the clip enables the area of the opening through the shield component to be minimized and enables the shield component to include flanges extending from sides of the opening along the legs of the clip so as to decrease the area open to X-ray emission and thus optimize the X-ray shielding capabilities of the connector assembly. In connection with connector assemblies heretofore provided, such as the connector assembly disclosed in my copending application mentioned above, the use of a shielding component completely surrounding the clip legs was not possible due to the flexing of the cap, clip and high voltage conductor required to achieve insertion of the preassembled conductor and clip into the cap as described hereinabove.

It is accordingly an outstanding object of the present invention to provide an anode connector clip assembly having improved structural integrity and strength with respect to the joint between the clip and the bare end of the high voltage conductor to optimize maintaining electrical continuity through the joint and restraining separation or displacement of the conductor from the connector clip.

Another object is the provision of an anode connector assembly having improved structural integrity with respect to separation of the connector clip assembly from the cap member.

Still another object is the provision of an anode connector clip assembly which optimizes shielding against X-ray emissions from a standard anode button without the necessity for auxiliary shielding components to attenuate emissions.

A further object is the provision of an anode connector assembly in which a connector clip is mechanically fastened to a bracket member anchored in the cap component to restrain separation of the clip from the cap and in which the bare end of the high voltage conductor is clamped between the bracket and clip against separation therefrom.

Yet another object is the provision of an anode connector assembly of the foregoing character which enables assembly of the component parts more expeditiously than heretofore possible and without subjecting the joint between the clip and high voltage conductor to undesirable stresses during the assembly operation.

Still another object is the provision of an anode connector assembly of the foregoing character which is economical to produce and easy to assemble while providing improved strength against pull apart of the component parts and an improved X-ray shielding capability.

BRIEF DESCRIPTION OF THE DRAWINGS

The foregoing objects and others will in part be obvious and in part pointed out more fully hereinafter in conjunction with the written description of a preferred embodiment of the invention shown in the accompanying drawings in which.

DESCRIPTION OF THE PREFERRED EMBODIMENT

Figure 1:
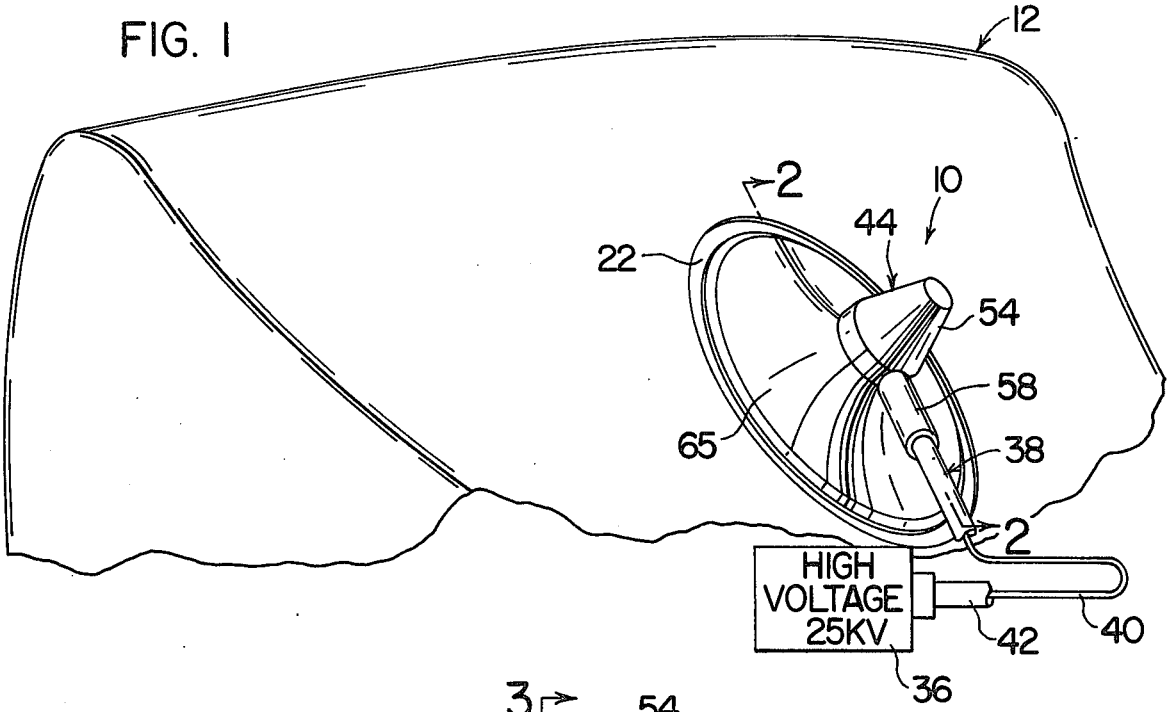
FIG. 1 is a partial perspective view of a cathode ray tube showing the connector assembly of the present invention operatively associated therewith.
Figure 2:
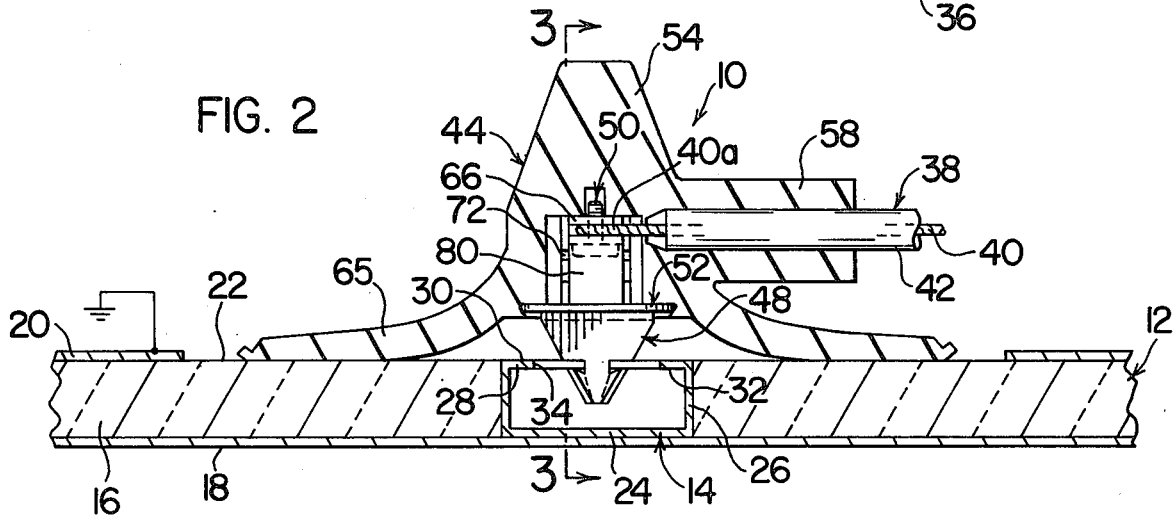
FIG. 2 is a cross-sectional view taken along line 2—2 of FIG. 1.
Figure 3:
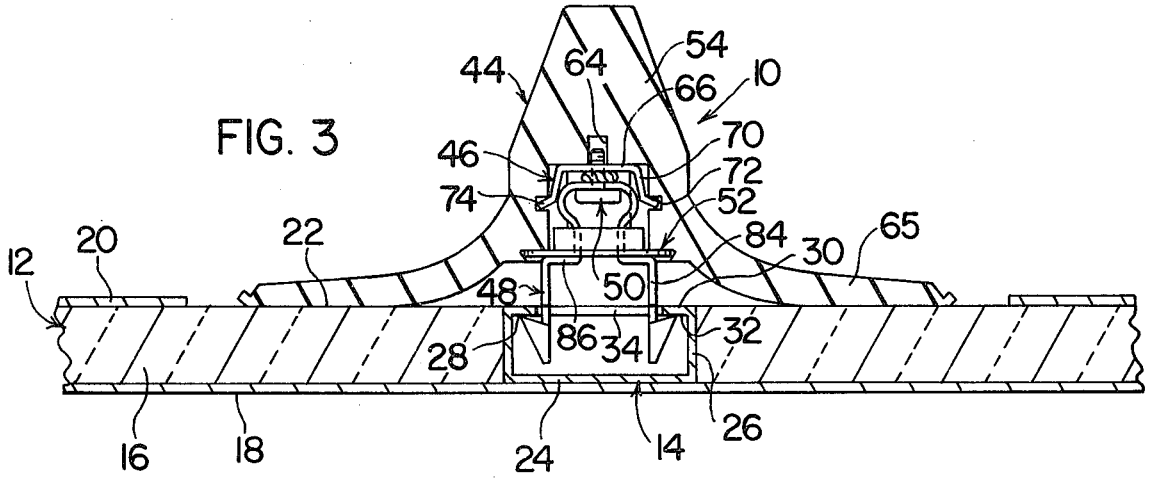
FIG. 3 is a cross-sectional view taken along line 3—3 of FIG. 2.
Figure 4:
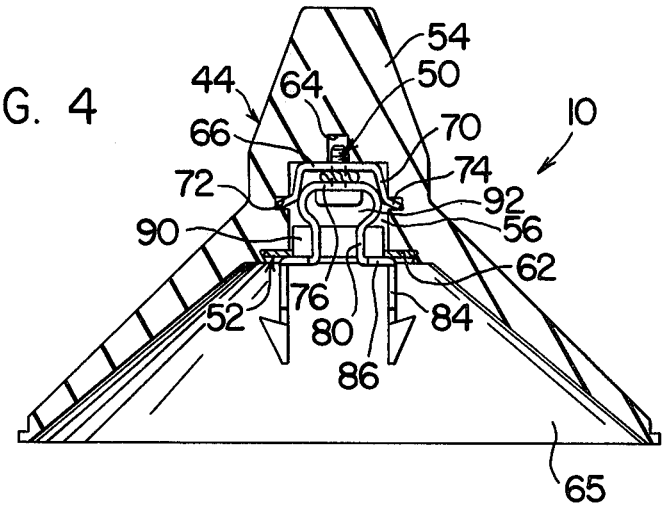
FIG. 4 is a cross-sectional view similar to FIG. 3 but showing the connector assembly disconnected from the anode button.
Figure 5:
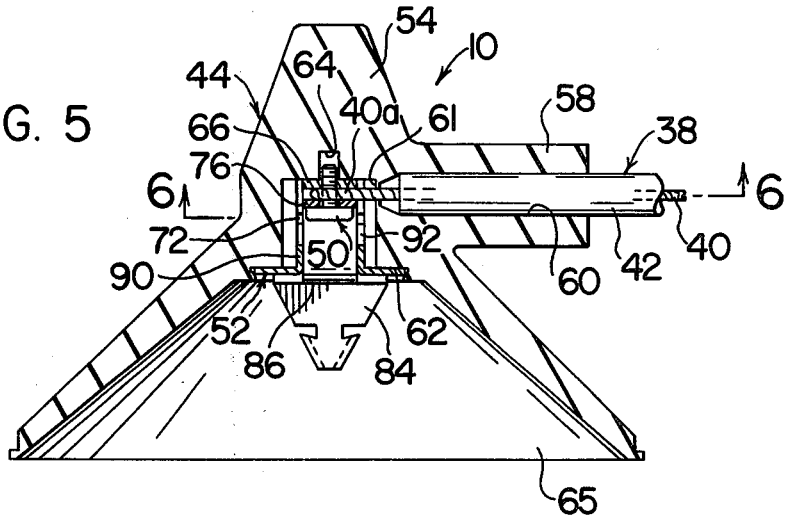
FIG. 5 is a cross-sectional view similar to FIG. 2 but showing the connector assembly disconnected from the anode button.
Figure 6:
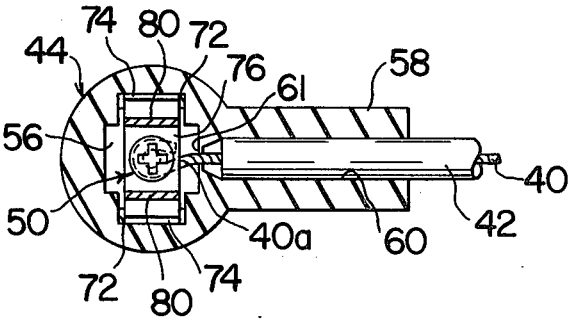
FIG. 6 is a detailed cross-sectional view taken along line 6—6 in FIG. 5.
Figure 7:
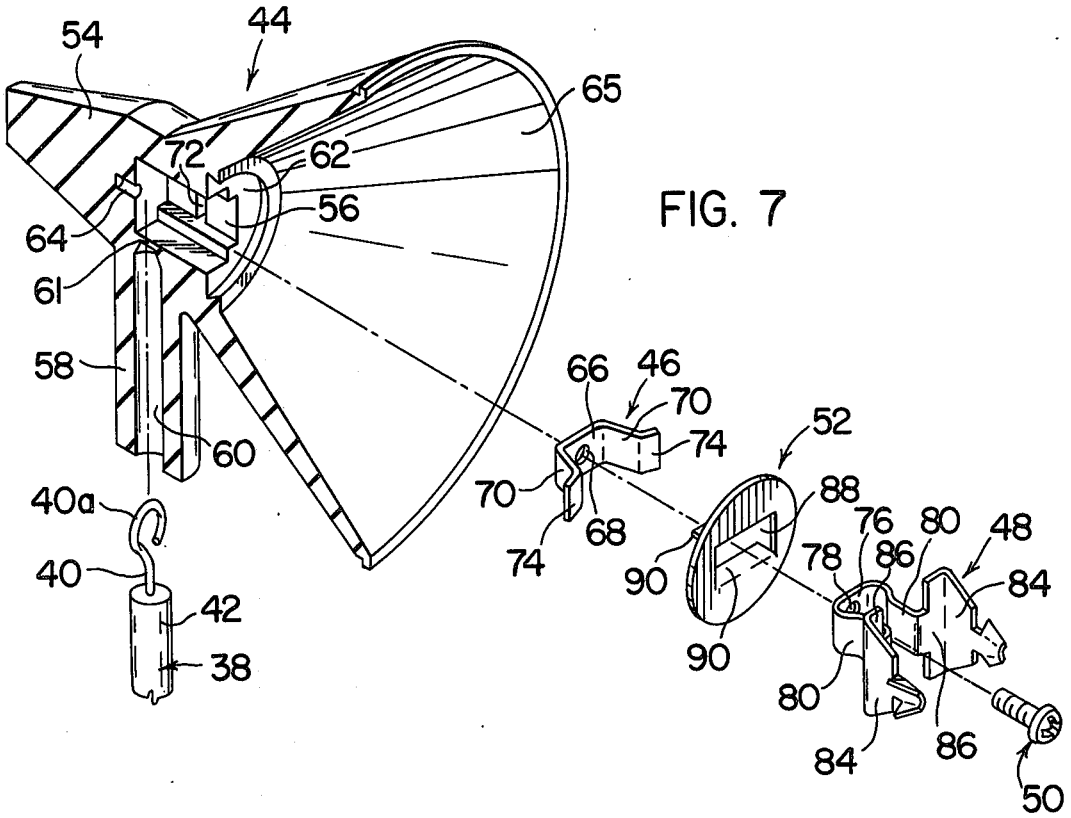
FIG. 7 is an exploded perspective view of the component parts of the connector clip assembly, cap member and high voltage conductor, and showing the cap member in cross-section.

Referring now in greater detail to the drawings wherein the showings are for the purpose of illustrating a preferred embodiment of the invention only and not for the purpose of limiting the invention, an anode connector assembly 10 in accordance with the present invention is illustrated in FIGS. 1, 2 and 3 in association with a cathode ray tube 12 having a standard anode button 14 embedded in envelope 16 thereof. Cathode ray tube 12 is conventional and forms no part of the present invention. Generally, the envelope 16 of such a tube is glass and is provided with a metal inner layer 18 which may either be conductive or shielding, and a metal grounded outer cover 20 which is discontinuous in the area of anode button 14 to provide a surface 22 of bare glass.

Anode button 14 is also conventional and is sealed within the glass envelope 16. Anode button 14 is approximately the thickness of envelope 16 and comprises a bottom portion 24, cylindrical sidewall 26, and a radially inwardly extending annular flange 28. Flange 28 includes a top surface 30 coplanar with outer surface 22 of envelope 16, an underside 32 parallel to outer surface 30, and a circular inner edge 34 between surfaces 30 and 32. Thus, flange 28 defines a circular opening into the cup-like interior of anode button 14.

A high voltage supply source 36 is shown schematically in FIG. 1, and the output of this source is generally in the range of 25 to 50 kilovolts D.C. A high voltage conductor 38 carries the anode current from high voltage source 36 to the clip assembly of the anode connector to be described hereinafter and which is inserted in anode button 14. Conductor 38 comprises a flexible metal conductor wire 40 encased in flexible insulating material 42. As will become apparent hereinafter, the end of conductor 38 remote from high voltage source 36 has a portion of the insulating material 42 removed to provide a bare end of the conductor wire 40 which is electrically connected to the clip assembly.

In the preferred embodiment of the present invention, as best seen in FIGS. 4–7 of the drawing, the connector assembly 10 includes a flexible shielding cap 44, and a connector clip assembly comprising a bracket member 46, a contact clip member 48, a threaded fastener 50 and an X-ray shielding member 52. Cap member 44 is made from a rubber-like flexible material which may be any natural rubber of synthetic elastomer which will provide the necessary effective resiliency and, preferably, is made from silicon rubber material. Flexible cap 44 has a centrally located head portion 54 provided with an internal cavity 56 which receives bracket member 48 and a portion of contact clip 46 as set forth more fully hereinafter. Cap 44 further includes a barrel portion 58 having a conductor passage 60 therethrough and opening at its inner end into cavity 56. Conductor passage 60 is normally of a diameter slightly smaller than the outside diameter of high voltage conductor 38 so that when the conductor is in passage 60 the material around the passage is under tension and tightly grips the outside of insulating sheath 42 of the conductor. As will be explained more fully hereinafter, bare end **40*a* of conductor wire 40 is formed into a loop and is inserted into cavity 56 through conductor passage 60. Preferably, cap 44 is formed with a thin membrane 61 of material between the inner end of conductor passage 60 and cavity 56. Membrane 61 can be pre-slit or can be ruptured by bare end 40***a* when conductor 38 is inserted into passage 60. This advantageously provides for the material of membrane 61 to tightly engage around conductor wire 40 behind looped end 40*a*. Head 54 of cap 44 is further provided with a generally flat annular surface 62 extending about the open end of cavity 56, and the inner end wall of cavity 56 is preferably provided with a small axially extending passage 64 for the purpose set forth hereinafter.

Flexible cap 44 further includes a skirt portion 65 extending from head 54 in the direction axially and radially outwardly with respect to the outer end of cavity 56. Skirt portion 65 may be structured as described with respect to the flexible cap member disclosed in my aforementioned copending patent application, and reference may be had to the latter for details concerning such structure of the skirt portion.

Bracket member 46 of the connector assembly is a generally U-shaped metal member having a base portion 66 provided with a pilot opening 68 therethrough for threaded fastener 50. Legs 70 of the U-shaped bracket are integral with base portion 66 and extend outwardly therefrom with respect to the open end of cavity 56. Bracket member 46 is adapted to be received in cavity 56 of cap member 44 with base 66 overlying the bottom wall of the cavity and legs 70 extending adjacent corresponding sidewalls of the cavity. The base and leg orientation is such that the axis of the U extends toward conductor passage 60 of the cap member. Bracket member 46 is adapted to be suitably retained in cavity 56 against displacement toward the open end of the cavity. In the embodiment shown this is achieved by providing opposed walls of cavity 56 with laterally extending recesses 72 and providing the outer ends of bracket legs 70 with laterally extending flanges 74 received in recesses 72 when the bracket member is positioned in cavity 56. When bracket member 46 is so positioned in cavity 56, base portion 66 of the bracket is positioned to underlie looped end 40*a* of high voltage conductor 38 when the looped end is introduced into cavity 56 through passage 60 and membrane 61.

Clip member 48 is a generally U-shaped member having a base portion 76 provided with an opening 78 therethrough for threaded fastener 50, and inner leg portions 80 integral with base portion 76 and extending outwardly therefrom with respect to the open end of cavity 56 of cap member 44. Clip member 48 further includes outer leg portions 84 each laterally outwardly offset from the corresponding leg portion 80 and integrally interconnected therewith by a corresponding intermediate leg portion 86. The outermost ends of outer leg portions 84 are structured to interengage with anode button 14 and, for this purpose, preferably are structured as disclosed in my aforementioned copending patent application.

Clip 48 is adapted to be retained in cap member 44 against separation therefrom axially outwardly of cavity 56 by interengagement of the clip member with bracket member 46. In this respect, the inner end of clip member 48 as defined by base portion 76 and inner leg portions 80 are introduced into cavity 56 of the cap member with legs 80 engaging between legs 70 of bracket member 46 and with base portion 76 of the clip member overlying the looped end 40*a* of the conductor 38. Threaded fastener 50 is then introduced through opening 78 in base portion 76 of the clip, and thence through looped end 40*a* of the conductor wire and into threaded engagement with pilot opening 68 in base portion 66 of bracket member 46. Fastener 50, which may be a sheet metal screw for example, is then rotated to draw base portion 76 of the clip toward base portion 66 of the bracket member so as to tightly engage looped end 40*a* of the conductor wire therebetween and to tightly interengage clip member 48 with bracket member 46. Passage 64 at the inner end of cavity 56 receives the inner end of threaded fastener 50 when the screw is in its fully seated position.

It will be appreciated from the foregoing description of the relationships between the component parts when assembled that looped end 40*a* of the high voltage conductor is clampingly engaged between the bracket and clip members and thus is held tightly against separation from the connector assembly by jerking outwardly on high voltage conductor 38. Further, it will be appreciated that bracket member 46 is firmly held in the cap against displacement axially outwardly of cavity 56 and, in conjunction with fastener 50, firmly holds clip member 48 against displacement axially outwardly of cavity 56.

In accordance with another aspect of the present invention, X-ray shielding is provided by interposing metallic shielding disc or washer 52 between the outer end of cavity 56 in cap member 44 and intermediate leg portions 86 of clip member 48. The structural combination of bracket member 46 and clip member 48 in accordance with the present invention advantageously enables the surface area of shielding member 52 to be greater than heretofore possible, thus optimizing the X-ray shielding capability thereof. In this respect, shielding member 52 can be in the form of a disc which is circumferentailly uninterrupted and provided with a central opening 88 therethrough adapted to closely receive inner leg portions 80 of clip member 48. Additionally, opening 88 can be provided by punching the metal disc so as to leave a pair of flanges 90 along opposite sides of the opening which extend downwardly into cavity 56 adjacent opposite side edges of inner leg portions 80. When the component parts are in assembled relationship, shielding disc 52 seats against annular flat surface 62 of cap member 44 and is engaged thereagainst by intermediate leg portions 86 of the clip member. Thus, in the assembled anode connector structure, opposed flanges 90 of the shielding disc span the spaces between clip legs 80 from intermediate leg portions 86 of the clip member toward base portion 76 thereof, whereby only a small space 92 between base portion 76 and the inner end of each flange 90 of the shielding plate is open to X-ray emission.

It is believed that the assembly of the component parts is obvious from the foregoing description. Briefly, however, bracket member 46 is first introduced into cavity 56 of cap member 44 for bracket flanges 74 to seat in recesses 72 of the cap member, and high voltage conductor 38 is then introduced into conductor passage 60 from the outer end thereof to position the bare looped end 40*a* of conductor wire 40 in overlying relationship with base portion 66 of the bracket member and in alignment with pilot opening 68 therethrough. Shielding disc 52 is then either positioned on annular surface 62 of the cap member or is introduced onto inner leg portions 80 of clip member 48, and leg portions 80 are then inserted into cavity 56 of the cap member. Thereafter, threaded fastener 50 is introduced through opening 78 in base portion 76 of the clip member, through looped end 40*a* of the conductor wire and into threaded engagement with pilot opening 68 in bracket member 46. Preferably, as will be seen from the drawings, the opposed walls of recess 56 are planar and parallel to one another and dimensioned to snugly receive bracket member 46, inner leg portions 80 of clip member 48 and flanges 90 of shielding plate 52 so as to restrain rotational displacement of the component parts relative to cap member 44. It will be appreciated that assembly of the component parts is easily and quickly achieved and that no distortion of the bare end of the conductor and/or the clip member takes place during such assembly, whereby structural integrity and electrical continuity through the joint between the conductor and clip is assured.

With reference again to FIGS. 2 and 3 of the drawing, it will be appreciated that the assembled anode connector assembly is joined with an anode button 14 by pressing the leg portions of clip member 48 toward each other so that the outermost ends thereof pass through opening 36 of the anode button. At this time, the legs are released and spring laterally outwardly so as to engage underside 32 of anode button flange 28. Alternatively, with the specific structure of the outermost ends of leg portions 84 of the clip herein illustrated and described in my aforementioned copending patent application, the clip can be aligned with respect to opening 34 of anode button 14 and merely pressed downwardly through the opening, whereby the outermost ends of the clip are cammed toward one another allowing the end of the clip to pass into the interior of the anode button. During insertion of the clip into the anode button, skirt portion 65 of cap member 44 is pressed resiliently downwardly and radially outwardly onto outer surface 22 of the cathode ray tube envelope creating a seal around and concentric with anode button 14 and resiliently biasing the clip member into engagement with the anode button against unintentional separation therefrom.

While considerable emphasis has been placed herein on the preferred structures of the component parts of the anode connector assembly, it will be appreciated that many changes can be made therein without departing from the principles of the present invention. Accordingly, it is to be distinctly understood that the foregoing descriptive matter is to be interpreted merely as illustrative of the present invention and not as a limitation.

Having thus described the invention, it is claimed:

1. An anode connector clip assembly for establishing electrical contact between a bare conductor portion of an insulated anode supply conductor and a standard anode button disposed in the side of a cathode ray tube, said assembly comprising sheet metal bracket means, sheet metal clip means separate from said bracket means, said clip means including a base portion and a pair of legs extending therefrom for engagement with said anode button, said bracket means and said base portion of said clip means receiving said bare conductor portion therebetween, and fastener means connecting said bracket means and said base portion of said clip means to clampingly interengage said bare conductor portion therebetween.

2. The assembly according to claim 1, and metal shield plate means separate from said clip means and said bracket means and surrounding said legs.

3. The assembly according to claim 1, wherein said bracket means is a generally U-shaped member having a pair of bracket legs and a bridging portion between corresponding ends of said bracket legs, said bare portion of said conductor being disposed on said bridging portion and between said bracket legs.

4. The assembly according to claim 3, wherein each of said bracket legs has a flange extending laterally outwardly of the corresponding bracket leg at a location spaced from said bridging portion.

5. The assembly according to claim 1, wherein said legs of said clip means include inner leg portions extending in one direction from said base portion, intermediate leg portions extending laterally outwardly from said first portions, and outer leg portions extending from said intermediate portions in said one direction and generally parallel to one another.

6. The assembly according to claim 5, and apertured metal shielding plate means surrounding said inner leg portions of said clip means between said base portion and said intermediate leg portions.

7. The assembly according to claim 5, wherein said outer leg portions each have an end spaced from said intermediate leg portion in said one direction and provided with means to interengage with said anode button.

8. The assembly according to claim 5, wherein said bracket means is a generally U-shaped member having a pair of bracket legs and a bridging portion between corresponding ends of said bracket legs, said bare portion of said conductor being disposed on said bridging portion and between said bracket legs, and said bracket legs extending in said one direction and receiving said base portion of said clip means therebetween.

9. The assembly according to claim 8, wherein each of said bracket legs has a flange extending laterally outwardly of the corresponding leg at a location spaced from said bridging portion.

10. The assembly according to claim 8, and apertured metal shielding plate means surrounding said inner portions of said legs of said clip means between said intermediate leg portions and said base portion.

11. The assembly according to claim 10, wherein said apertured shielding plate means includes a rectangular aperture therethrough and flange means extending along an opposite pair of the side edges of said aperture, said flange means of said shielding plate means extending therefrom in the direction opposite said one direction.

12. The assembly according to claim 11, wherein said flange means of said shielding plate means are in planes transverse to said inner leg portions of said clip means.

13. The assembly according to claim 1, further including a flexible shielding cap disposed about said conductor, bracket means and clip means.

14. The connector assembly according to claim 13, wherein said shielding cap includes a head portion having a cavity receiving said bracket means and clip means, said legs of said clip means extending axially outwardly of the open end of said cavity, a barrel portion extending from said head portion and having passageway means receiving said conductor, and a skirt portion extending radially outwardly and axially forwardly of said cavity.

15. The assembly according to claim 14, wherein said bracket means is a U-shaped bracket having legs extending toward said open end of said cavity, said bracket legs having outer ends terminating in laterally outwardly extending retaining flanges, and said shielding cap including recesses opening laterally into said cavity and receiving said flanges to retain said bracket in said cavity.

16. The assembly according to claim 15, wherein said U-shaped bracket includes a bridging portion between said bracket legs and parallel to said base portion of said clip means, said base portion being positioned forwardly of said bridging portion with respect to said open end of said cavity, and said fastener means being a threaded fastener having a head engaging said base portion and a threaded shank extending through said base portion and into threaded engagement with said bridging portion.

17. The assembly according to claim 15, wherein said legs of said clip means include inner portions extending in one direction from said base portion, intermediate portions extending laterally outwardly from said inner portions, and outer portions extending from said intermediate portions in said one direction and generally parallel to one another, said inner portions of said legs of said clip means being disposed in said cavity, and said intermediate portions of said legs extending laterally outwardly from said cavity at said open end thereof.

18. The assembly according to claim 17, and an apertured metal shielding plate surrounding said inner portions of said legs of said clip means and disposed between said intermediate portions of said legs and said shielding cap at said open end of said cavity.

19. The assembly according to claim 18, wherein said metal shielding plate has a rectangular opening therethrough and flanges extending axially of said rectangular opening from opposite sides thereof and into said cavity.

20. The assembly according to claim 19, wherein said opposite sides of said rectangular opening through said shielding plate extend in the direction between said inner portions of said legs of said clip means.

21. The assembly according to claim 20, wherein said bracket legs are spaced apart in the direction between said inner portions of said legs of said clip means to recieve said base portion of said clip means therebetween.

22. The assembly according to claim 21, wherein said U-shaped bracket includes a bridging portion between said bracket legs and parallel to said base portion of said clip means, said base portion being positioned forwardly of said bridging portion with respect to said open end of said cavity, and said fastener means being a threaded fastener having a head engaging said base portion and a threaded shank extending through said base portion and into threaded engagement with said bridging portion.

23. The connector assembly according to claim 22, wherein said legs of said bracket are spaced apart in the direction between said inner portions of said legs of said clip.

24. An anode connector assembly for establishing a shielded electrical connection between a bare conductor portion of an insulated anode supply conductor and a standard anode button disposed in the side of a cathode ray tube, said assembly comprising a flexible shielding cap including a head portion having an axis and a skirt portion coaxial with said head portion, said head portion having an end and said skirt portion extending radially and axially outwardly with respect to said end, said head portion having a cavity extending axially thereinto from said end, said cavity having an outer end at said end of said head portion, said head having a conductor passageway opening laterally into said cavity at a point spaced inwardly from said outer end thereof, a U-shaped sheet metal bracket in said cavity and having a bridging portion and bracket legs extending therefrom in the direction toward said outer end, said bridging portion being disposed in said cavity to receive said bare portion of said conductor thereon and between said bracket legs, said bracket and cavity including interengaging means to restrain axial and rotational displacement of said bracket relative to said cavity, a sheet metal clip having a base portion in said cavity and a pair of legs extending from said base portion and having outer ends within said skirt portion for engagement with said anode button, said base portion overlying said bare portion of said conductor on said bridging portion, and a threaded fastener having a head engaging said base portion and a threaded shank extending through said base portion and into threaded engagement with said bridging portion to clampingly interengage said bare portion of said conductor therebetween.

25. The connector assembly according to claim 24, wherein said means interengaging said bracket and cavity include laterally outwardly extending flanges on said bracket legs and recesses in said head portion extending laterally outwardly from said cavity and receiving said flanges.

26. The connector assembly according to claim 25, and a metal shield plate at said outer end of said cavity surrounding said legs of said clip and overlying said end of said head portion, said legs of said clip including leg portions engaging said shield plate against said end of said head portion.

27. The connector assembly according to claim 26, wherein said shield plate includes an aperture through which said legs of said clip extend and flanges extending from said aperture into said cavity and in the direction between said legs of said clip.

28. The connector assembly according to claim 27, wherein said legs of said clip include inner portions in said cavity, intermediate portions extending laterally outwardly from said inner portions and providing said leg portions engaging said shield plate, and outer portions extending from said intermediate portions and providing said outer ends for engagement with said anode button.

* * * * *

Disclaimer 4,155,614.—*Harold E. Hall,* Middlefield, Ohio. CONNECTOR ASSEMBLY FOR ANODE BUTTON OF A CATHODE RAY TUBE. Patent dated May 22, 1979. Disclaimer filed Oct. 22, 1984, by the assignee, *Blasius Industries, Inc.*

Hereby enters this disclaimer to claims 1, 3, 4, 5, 7, 13 and 14 of said patent.

[*Official Gazette December 4, 1984.*]